US006077159A

United States Patent [19]

Clayton

[11] Patent Number: 6,077,159

[45] Date of Patent: Jun. 20, 2000

[54] APPARATUS AND METHOD FOR PASSIVE VENTILATION OF BUILDINGS

[75] Inventor: Gerald W. Clayton, Liberty, Mo.

[73] Assignee: CTI Building Systems, Liberty, Mo.

[21] Appl. No.: 08/707,643

[22] Filed: Sep. 5, 1996

[51] Int. Cl.[7] ..... F24F 7/02

[52] U.S. Cl. ..... 454/250; 52/199; 454/260; 454/365

[58] Field of Search ..... 454/250, 260, 454/265; 52/95, 199

[56] References Cited

U.S. PATENT DOCUMENTS

| | | | |
|---|---|---|---|
| 4,325,290 | 4/1982 | Wolfert | 454/365 |
| 5,022,314 | 6/1991 | Waggoner | 454/365 X |

FOREIGN PATENT DOCUMENTS

| | | | |
|---|---|---|---|
| 59-109732 | 6/1984 | Japan | 454/365 |
| 2 189 024 | 10/1987 | United Kingdom | 454/365 |

OTHER PUBLICATIONS

Metallic Products Corporation P.O. Box 36302 Houston, TX 77018 Advertising of Ridge vent, Date Unknown, p. 1.

Plyco Corporation Elkhart Lake, WI 53020 Low Profile Ridge Ventilator Advertisement, Date Unknown p. 1.

Klauer Manufacturing Company P.O. Box 59 Dubque, IA 52004–0059 Roofline Ridgolator Advertisement Date Unknown, p. 1.

Metal Roof and Wall Systems 14031 West Hardy Houston, TX 77238 MBCI Ridge Ventilator Systems 1986, pp. 1–4.

Cor–A–Vent, Inc. 16250 Petro Drive Mishawaka, IN 46544 Advertising, 1992, pp. 1–8.

GAF Materials Corporation 1361 Alps Road Wayne, NJ 07470 Cobra Ventilation Products, Advertising, 1995, pp. 1–20.

*Primary Examiner*—Harold Joyce
*Attorney, Agent, or Firm*—Lathrop & Gage, LC

[57] ABSTRACT

An apparatus and method for passive ventilation of buildings includes a bracket which cradles an air permeable member. The bracket and cradled air permeable member are interposed in air pathways comprising air inlets and air outlets for the building. The bracket provides a substantial area for air flow through the air permeable material, but is low profile, assists in the structural strength of the connection of building parts, and deters damage or deformation of building parts when installed.

21 Claims, 4 Drawing Sheets

4-4

56
50
14
70
72
74
76
78
80
82
84
86
88
90
92
94
96
98
100
102
104
106
108
110
112
114
116
118
120
122
124
126
128
130
132
134
136
138
140
142
144
146
148

APPARATUS AND METHOD FOR PASSIVE VENTILATION OF BUILDINGS

BACKGROUND OF THE INVENTION 1.1. Field of the Invention

The invention relates generally to ventilation systems for buildings, and in particular, to passive ventilation systems installed at the roof peak or eaves of the building.

1.2. Problems in the Art

It is generally desirable that fresh air be brought into buildings. A variety of ways exist to try to accomplish this goal. Some systems utilize air conditioners, fans, or other electrically or otherwise powered mechanisms. Such systems are costly to purchase, install and maintain. They also represent ongoing costs such as electric or fuel costs operation.

Passive ventilation systems, also widely known, utilize pressure differences or wind-powered rotors or fans to attempt to set up circulation within the building. There are no on-going energy costs. A few examples of such systems are turbine vents, roof louvers, and soffit vents.

While passive systems do provide a generally more economical solution to air ventilation, especially in low cost non-residential buildings, there are certain considerations that are not always satisfactorily addressed by present systems.

Ideally, the system would prevent such things as rain, snow, ice, or direct wind from entering the building. Prevention of entry of such things as dirt, insects, birds and other animals is also desirable.

On the other hand, it is generally true that the bigger the air passages in and out of the building, the better the potential to create beneficial ventilation. Larger air passages tend to involve larger gaps or spaces between structure, and thus more complex and costly structure to keep out the elements, debris, insects and animals.

Moreover, to promote air flow, many passive systems extend significantly above the roof line of the building. This can be unsightly and can provide a profile that is easier to penetrate or less protected than one closer to the roof line. Also, higher profiles can lead to drift loading on roofs in high snow areas.

Still further, many passive systems do rely on wind or pressure driven parts, such as turbines which, because they are moving parts, can get damaged and can malfunction or operate at less than full effectiveness. The more mechanically complex and larger profile devices also are more susceptible to damage when shipped, installed or serviced. Additionally, they generally take up more space in inventory and are more difficult and time-consuming to install.

Many existing products or methods are suited better to specific building structures or ventilation situations, and therefore are not necessarily universal or flexible in their application.

OBJECTS, FEATURES, AND ADVANTAGES OF THE INVENTION

Therefore, a primary advantage of the present invention is the provision of an apparatus and method of passive ventilation of buildings which improves over the problems and deficiencies in the art.

Further exemplary objects, features, and advantages of the present invention include the provision of an apparatus and method of passive ventilation of buildings which:

1. is effective against penetration of almost any unwanted animal, insect, debris, solid, or weather elements such as rain, snow, ice, and direct wind.
2. is effective to deter heat and moisture buildup in roofs and attics.
3. has no moving parts and is structurally non-complex.
4. is low profile and can be incorporated in a low profile into existing building roofs, hip roofs, and eaves.
5. is convenient and efficient to ship and hold in inventory.
6. works with a wide variety of buildings and ventilation needs.
7. is relatively economical compared to many existing passive or powered ventilation systems or methods.
8. is relatively easy to install and maintain.
9. is long-lasting and durable.
10. does not result in damage or deformation of existing building structures and components when installed.
11. can be easily retrofitted to existing buildings or installed as a part of new construction, and can be customized according to desire.

These and other objects, features, and advantages of the present invention will become apparent with reference to the accompanying specification and claims.

SUMMARY OF THE INVENTION

The present invention includes a system of passive ventilation of buildings. According to one aspect of the invention a bracket is utilized at either the air inlet, air outlet, or both, which cradles an air-permeable member which is interposed in the air pathway through the inlet or outlet. The bracket provides a significant amount of unblocked exposure of the air pathway to the air-permeable member to promote maximum air flow, yet effectively blocks animals, insects, solids and unwanted weather elements from entering the building. The eave bracket also provides independent structural support when attaching items to the bracket, and the bracket can provide independent structural support for attachment of parts of the roof to the building.

According to another aspect of the invention, a passive ventilation system is disclosed which has no moving parts, is low profile, and uses air-permeable filters interposed in the air inlet and air outlet to the building.

According to another aspect of the invention, a method is disclosed of interposing an air-permeable filter in the air inlet and air outlet of a building to promote ventilation of the building.

The invention is flexible in its application to a number of building types and roof and wall materials, and presents a low profile when installed.

DETAILED DESCRIPTION OF THE PREFERRED EMBODIMENT(S)

4.1. Overview

Figure 1:
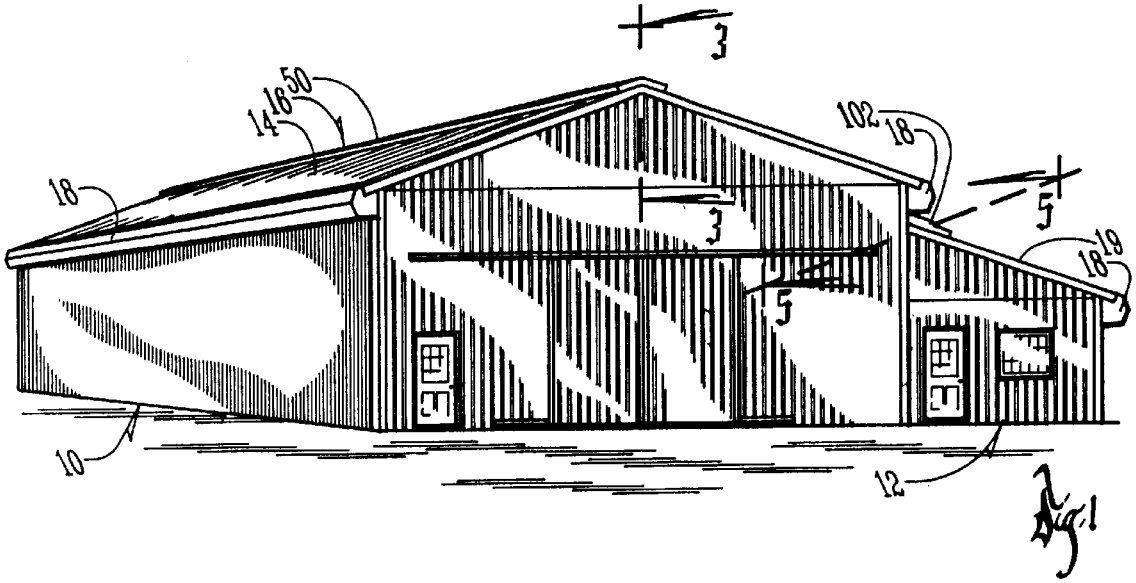
FIG. 1 is a perspective view of a building utilizing a preferred embodiment according to the invention.

To achieve a better understanding of the invention, a preferred embodiment will now be described in detail. Frequent reference will be taken to the drawings which have been identified immediately above.

Reference numerals will be used to identify certain parts and locations in the drawings. The same reference numerals will be used to identify the same parts and locations throughout the drawings unless otherwise stated.

4.2. Environment

FIG. 1 illustrates a main building 10 having a roof 14. A side or lean-to building 12, with a lean-to roof 19 is also shown. Roofs 14 and 19 are in this example corrugated such as are known in the art, having alternating ridges and troughs extending between the ridge top of each roof and its respective eaves.

Buildings 10 and 12 enclose an interior space that is substantially isolated from the exterior by the use a foundation, windows and doors. The facade of buildings 10 and 12, in this example, are comprised of corrugated panels, which are widely used because of their strength and economy.

A passive ventilation system is incorporated into buildings 10 and 12 by creating air passages on both sides of roof ridge cap 50 (which function as the air outlets because warm air generally rises to the highest point in a building), at hip roof or lean-to roof connection 102 (the air outlet for building 12), and at eaves 18 of both buildings (which function as air inlets).

The ventilation system can extend to entire length of the roof, or a portion thereof.

4.3. Apparatus

Figure 2:
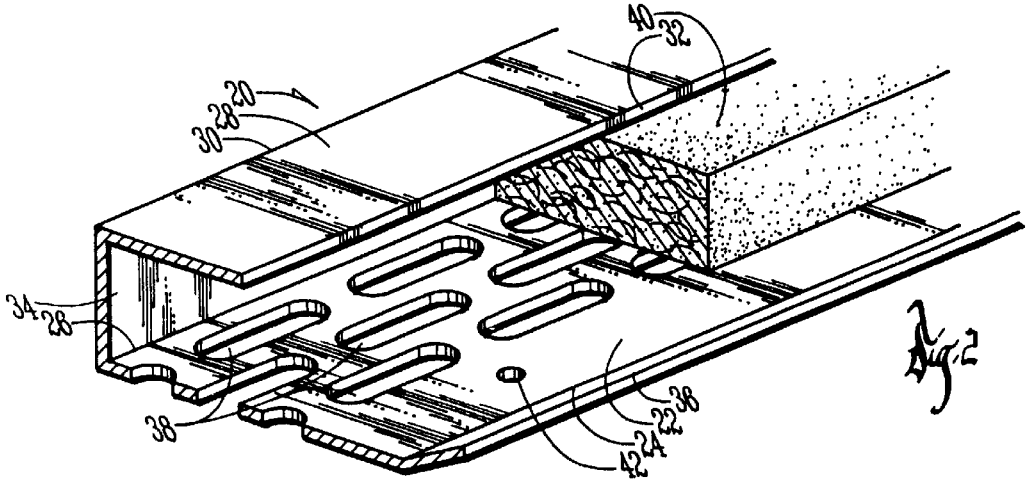
FIG. 2 is an isolated enlarged perspective view of a bracket according to a preferred embodiment of the invention.

FIG. 2 shows in detail a bracket 20 that is used in the ventilation system for buildings 10 and 12. Bracket 20 can take many forms, but the style shown in FIG. 2 includes what will be called a base wall 22 which is elongated along a longitudinal axis and includes edges 24 and 26 on its opposite lateral sides. Upper wall 28 extends over and above base wall 22 along the length of base wall 22. Upper wall 28 has opposite lateral edges 30 and 32. Connection wall 34 extends between edge 26 of base wall 22 and edge 30 of upper wall 28 and serves to define the spacing and orientation of upper wall 28 relative to base wall 22.

As can be seen in FIG. 2, in this style of bracket 20, an angled extension 36 extends from edge 24 of base wall 22. Also, a plurality of openings 38 are equally spaced apart in a staggered fashion through a portion of base wall 22. Note that openings 38 are all towards the side of base wall 22 nearest edge 26, leaving an area nearest edge 24 without any openings 38. Several apertures 42 can be positioned in that area, however, and serve to receive fasteners such as machine or metal screws or nails. Openings 38 are elongated in shape (for example, 1-⅛" long or 1-⅝" long) and provide a substantial amount of open area in base wall 22. Openings can be of different shapes and sizes and spacings. For example, they could be elongated along or transverse to the longitudinal axis of bracket 20. They could also be of symmetrical shape.

Bracket 20 therefore has generally a "J-shape", lying on its long side, when viewed on end or in cross section. Upper wall 28 extends only partially over base wall 22. As can be seen in FIG. 2, a filter 40 can be positioned inside the "J-shape" so that one side of filter 40 abuts connection wall 34, the bottom side covers apertures 38 and the top does not extend to the bottom side of upper wall 28. As such, filter 40 is basically cradled by base wall 22 and connection wall 34. Upper wall 28 does not abut filter 40, but does serve to prevent it from moving vertically past upper wall 28. Angled extension 36 serves to deter movement of filter 40 laterally out of bracket 20. The use of bracket 20 and filter 40 will be discussed with respect to a passive ventilation system later. Upper wall 28 can be the point of attachment of the roof or flashings.

Filter 40 is a COBRA® RIDGE VENT available from GAF Materials Corporation of Wayne, N.J.. COBRA® is a registered trademark of GAF Materials Corp. It is a single-layer, non-fabric-covered ridge vent on a coil. It is available in rolls of lengths of many different feet (e.g. 20' or 50'). It is a strong, durable, modified polyester, non-woven, non-wicking, fiber-based matting of three-dimensional construction.

Further characteristics are as follows: UV stable, polyester composite. Maintenance-free when properly installed. Easily installed without special tools. Joints can be simply cut square, butted and caulked without connectors or baffles. Will not crack, dent, or rust, and has no sharp edges. Is flexible, easy to handle and transport and conform to any roof pitch from 2/12 to 20/12.

The material has a net free area of 16.9 sq. in. per lin. ft. Air flow is unrestricted by any fabric covering. It further has air permeability of greater than 760 cu. ft. per minute, tear and tensile strength of machine 25 p.p.i., a self ignition temperature of 963 degrees F., a cold crack resistance of minus 25 degrees F., and allows no snow infiltration.

Filter 40 therefore provides adequate air permeability qualities combined with other features that are beneficial with the passive ventilation system of this preferred embodiment.

4.4. System Operation

Figure 3:
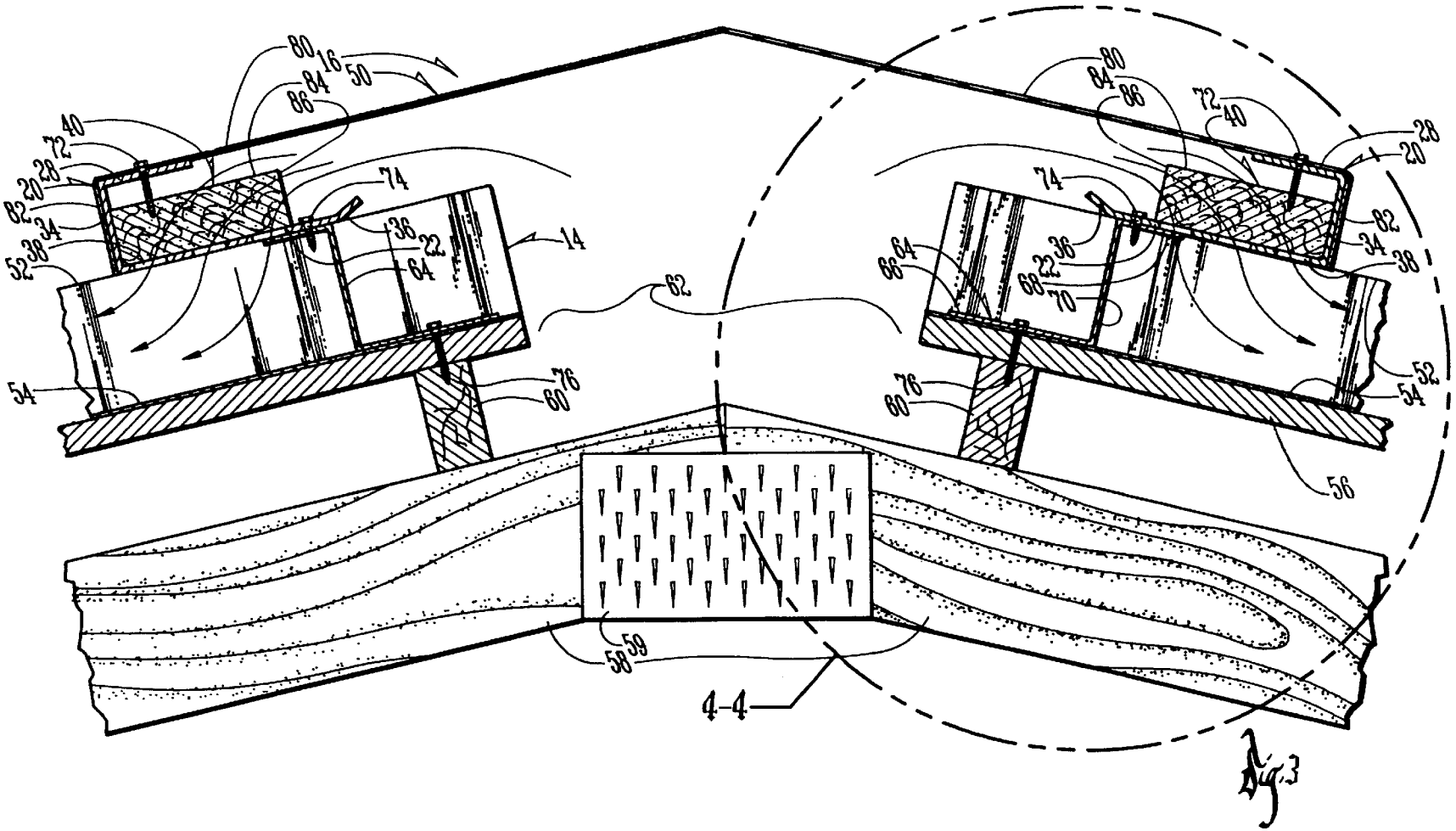
FIG. 3 is an elevational sectional view taken along line 3—3 of FIG. 1 showing a ridge vent.
Figure 4:
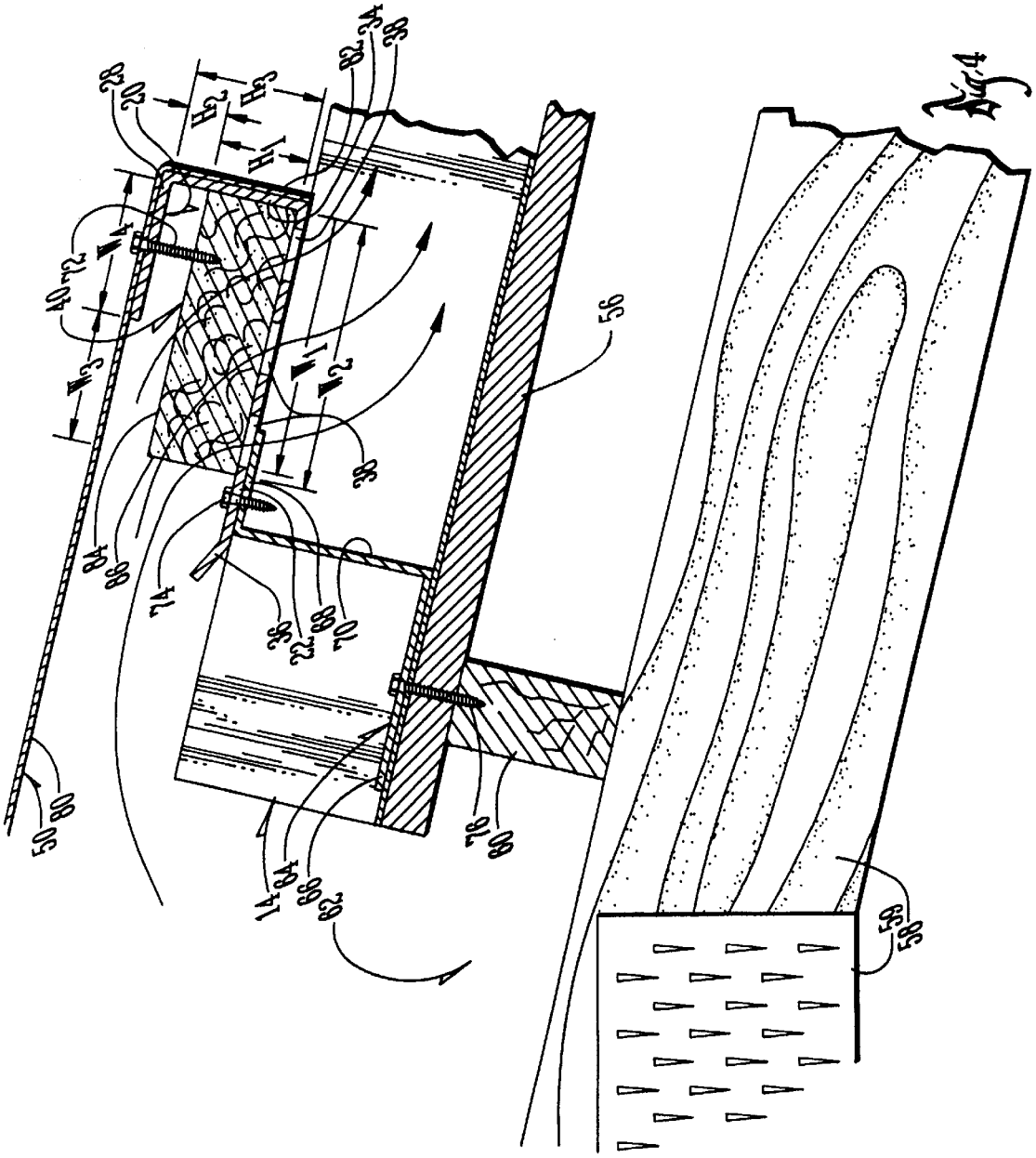
FIG. 4 is an enlarged view of the area indicated by line 4—4 of FIG. 3.
Figure 5:
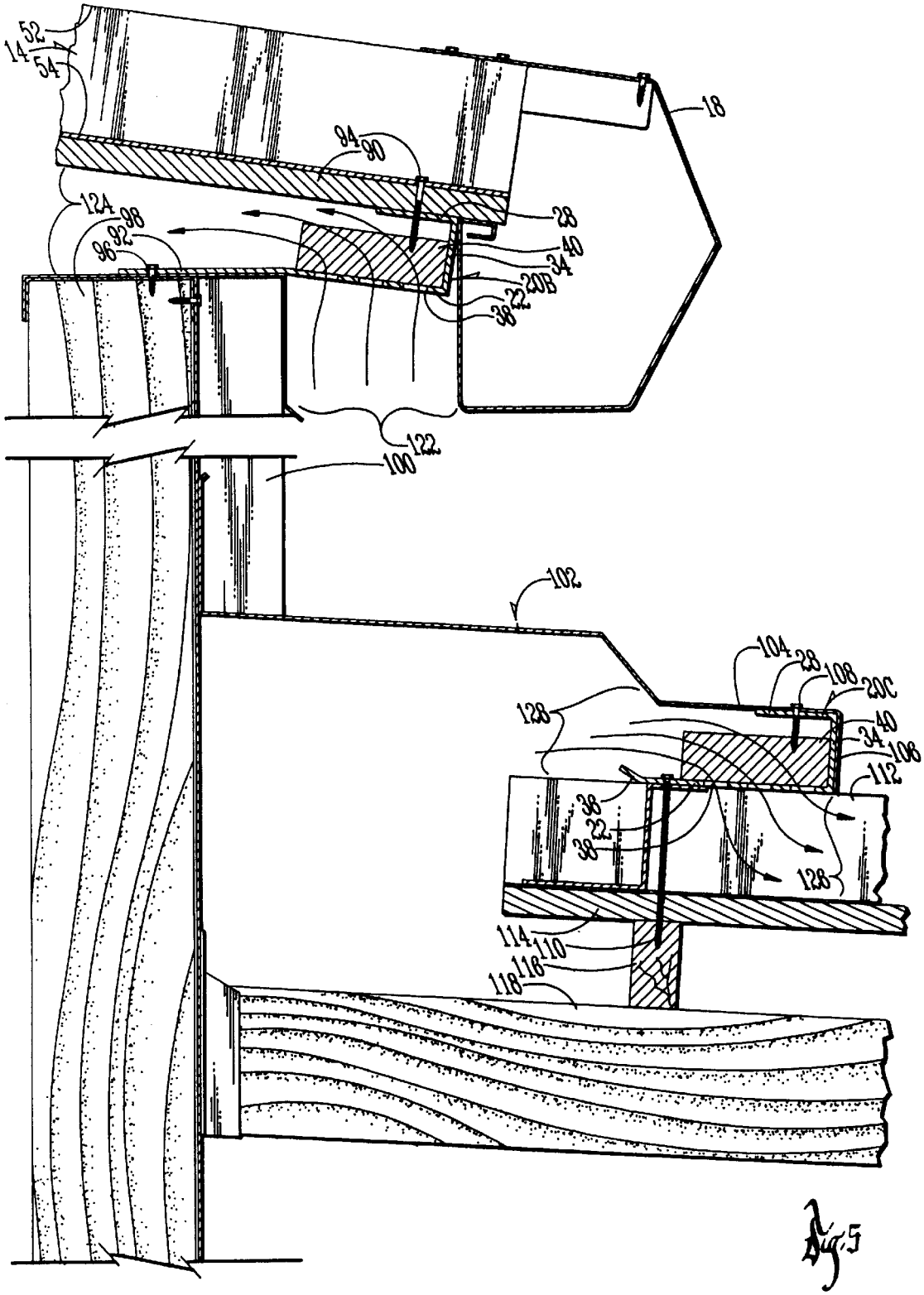
FIG. 5 is an elevational sectional view taken along line 5—5 of FIG. 1.

Operation of the passive ventilation system of FIG. 1 can be seen with reference to FIGS. 3–5. FIG. 3 illustrates the installation of two brackets 20 on opposite sides of roof cap 50. By referring to FIG. 1, ridge cap 50 extends all the way along roof 14 from the front of building 10 to its back. It is basically transverse to the ridges 52 and troughs 54 of the corrugated roof panels making up the outer side of roof 14. As can be seen in FIG. 3, a conventional way to build roof 14 is to extend roof rafters 58 into abutment at a peak and secure them with fasteners 59. Cross members or purlins 60 extend across and on top of rafters 58 and elevate panels 56 from rafters 58. Panels 56 have secured to them the corrugated roof panels that form the exterior of roof 14. The interconnection of elements 58, 60, 56, and 14 are well known in the art and not shown or discussed here.

A metal or rubber closure 64 is fastened to the bottom of trough 54 of roof 14 and extends upwardly to the level of ridge 52 of roof 14 on each side of opening 62 that exists above the peak of rafters or truss top chords 58.

Ridge cap 50 is intended to cover opening 62 (for example, 2" across). Metal closures include bottom 66 fastened by screw 76 to trough 54, top 68 fastened by screw 74 to bracket 20, and vertical wall 70 there between. It is to be understood that closures 64 are positioned in each trough 54 of corrugated roof 14 and extend across the width of troughs 54 to block entrance of weather elements, animals, or insects. Mastic adhesive or other substances such as caulking or sealants or other methods could be used to help secure and seal closures 64 in position. Other types of closures could be used, for example, rubber seals or closures such as are known in the art.

FIG. 3 also shows that bracket 20, attached through apertures 42 to closure 64, extends towards the outward edge of roof 14 over trough 54. Connection wall 34 extends upwardly in a closely nesting or mating relationship with the side wall 82 of ridge cap 50, and upper wall 28 extends back towards the roof ridge, also closely mating with the upper surface of cap 50, but underneath cap 50. Screws 72 are used to secure cap 50 to upper wall 28 of brackets 20.

As can be appreciated, bracket 20 provides a rigid support underneath cap 50 so that screws 72 can be screwed down through upper surface 80 of cap 50 and into upper wall 28 of bracket 20 to hold cap 50 in position without dimpling cap 50. Note that screw 72 can also be selected to be a length that it enters filter 40 and thus helps hold filter 40 in place in bracket 20.

Many of the fasteners used are self-drilling screws with threads all along their stems. Other types of fasteners are possible. Examples are wood screws or nails. Also the size and nature of the fasteners can vary according to what they have to secure and what they have to pass through or into.

By this configuration, an air pathway beginning inside cap 50 extends through filter 40, through openings 38 in bracket 20, and out trough 54 of roof 14. Similar installations of brackets 20 between closures 64 and cap 50 can be completed all along the roof ridge. Therefore, all troughs are blocked by closures 64 forcing air, weather elements, animals, insects, and debris to attempt to enter through openings 38 in brackets 20. Filter 40, covering all openings 38, admits only air. It does not even allow wind to pass because of its make-up.

The structure and cooperation of bracket 20, filter 40 and roof ridge cap 50 can be further seen in FIG. 4. Distance W1 is approximately 2-¼, while distance W2 is approximately 3", showing that filter 40 extends past the outer margin of openings 38 in bracket 20 to completely cover those openings. Distance W3 is 2". W4 is 1 ½", which is less than half the width of filter 40.

Distance H1 is 1" whereas distance H3 is 1 ½". This leaves a space of around ½" between the top of filter 40 and the bottom of upper wall 28 of bracket 20 or cap 50. Thus a substantial amount of the top surface 84 and end 86 of filter 40 are exposed and open to the air pathway to maximize air flow.

An advantage of the configuration shown in FIGS. 3 and 4 is that ridge cap 50 maintains a low profile (here on the order of 1 ½"). And yet an air pathway through most of filter 40 (1-⅛") and the approximately 2" width of openings in bracket 20 is accomplished.

Of course, a variety of sizes and dimensions of bracket 20 are possible according to need or desire. The basic shape of bracket 20 includes 90 degree angles between base wall 22, connection wall 34, and upper wall 28. Some variation may be possible. The shape and size can be customized for particular applications, and even can be custom bent if needed.

FIG. 5 illustrates brackets 20B and 20C used with eaves 18 and hip roof, lean-to, or side wall-connection 102 respectively. Upper wall 28 of bracket 20B attaches by screw 94 to the underside 90 of the portion of roof 14 near eaves 18. Openings 38 in base wall 22 span an open area 122 between eaves 18 and outer vertical wall 100 of building 10. An extended portion 92 from base wall 22 is used to secure bracket 20B to vertical stud 98. Open area 124 therefore is formed between the bottom of roof 14 and the walls and studs 100 and 98 so that an air pathway from outside building 10 through openings 38 and much of filter 40 into building 10 is achieved. Note again that screw 94 can extend into filter 40 to hold it in place.

Bracket 20C is substantially identical to bracket 20 of FIG. 3. Hip roof, lean-to, or wall connection 102 has an upper surface 104 attached to upper wall 28 of bracket 20C with screw 108. Upper wall 28 prevents dimpling or deformation of surface 104 when screw 108 is set into place. Surface 104 and side 106 of cap 102 mate with bracket 20C. Base wall 22 of bracket 20C is attached to closure 64 by screw 110, which extends all the way through panel 114 and into cross member or rafter 116 (which is secured to beam 118 by means not shown but well known in the art) to assist in securing the assembly. An air pathway from open area 128 inside cap 102 through filter 40 and out open area 126 beneath openings 38 is established.

It can therefore be seen that utilization of the basic combination of brackets such as 20 and 20B allows a complete passive ventilation system to be installed using filter material 40 at both the roof ridge and the eaves area of building 10. Likewise ventilation is set up in the side building 12 by use of bracket 20C at side wall connection 102 with a bracket like 20B associated with the eaves of lean-to roof 19 (not shown in FIG. 5 because it would be essentially the same as bracket 20B and eaves 18 as shown in FIG. 5).

4.5. Alternatives/Options

The included preferred embodiment is given by way of example only, and not by way of limitation to the invention, which is solely described by the claims herein. Variations obvious to one skilled in the art will be included within the invention defined by the claims.

It is to be understood, for example, that bracket 20 can take on a variety of configurations to accommodate different needs. Several models could generally cover most applications, however, customization is easily achieved. In most instances, the basic relationship between base wall 22, connection wall 34, upper wall 28, openings 38 and filter 40 will exist similar to that shown in the drawings.

The invention can also be used with a variety of building walls, roofs, eaves, and supporting structures or exterior coverings. Bracket 20 can be made of different materials including, but not limited to, metals and plastics. It is generally preferable that if metal, the same metal be used for the roof and the bracket, for example, steel with steel, aluminum with aluminum, and copper with copper. Also the gauge of brackets 20 can vary according to need. Examples are 16 gauge and 24 gauge.

A variety of fasteners can also be used, such as is well within the skill of those skilled in the art. Likewise, the size and shape of openings 38 can vary.

The invention also does not require any particular filter construction or material, but characteristics inherent in the COBRA® material are preferred.

The invention works with nearly all types of metal roofing panels and standing seam systems, as well as other roof and building structures. The embodiments discussed above are designed for ridge and hip venting and work with standard closures and ridge caps. The edge may be covered by adding a 1-½"×1-½" angle trim or a 1-½" 90 degree bend to the ridge cap. The gauge of the bracket 20 should be selected to match the gauge of the metal closure 64, if relevant.

Bracket 20 works with corrugated roofs, but could be configured to work with non-corrugated roofs. Bracket 20B works with corrugated and non-corrugated roofs and structures. As can be appreciated, the brackets according to the present invention can be configured in a variety of shapes, sizes and configurations, and for a variety of applications. The extensions 36 or 92 can be appropriately manufactured to allow such flexibility in application.

I claim:

1. A building vent system comprising:

a first surface;

a second surface spaced apart from the first surface;

a connecting member holding the second surface in spaced apart position from the first surface;

a plurality of openings in the first surface;

an air permeable member placed on the first surface in covering relation to the openings, the air permeable member having a top surface that does not extend to the second surface, to provide a air outlet area between the top surface of the air permeable member and the second surface and the connection member;

so that an air pathway is provided between the apertures, through the air permeable member, and the air outlet;

a first building component mounted by fasteners over the second surface;

a second building component mounted by fasteners under the first surface.

2. The system of claim 1 wherein the first surface is a plate member elongated along a longitudinal axis and having a transverse width and opposite edges.

3. The system of claim 2 wherein the second surface is a plate member elongated along a longitudinal axis and having a transverse width and opposite edges.

4. The system of claim 3 wherein the connection member is a plate member elongated along a longitudinal axis and having opposite edges which are connected to one of said opposite edges of the first and second surfaces.

5. The system of claim 1 wherein the first surface, connection member, and second surface comprise a J-shape in cross-section.

6. The system of claim 5 wherein the second surface has a width that is less than the width of the first surface.

7. The system of claim 1 wherein the first building component is a roof ridge cap having a top portion and side wall configured to matingly cover the second surface and connection member.

8. The system of claim 7 wherein the second building component is a roof top.

9. The system of claim 8 wherein the roof top is corrugated and includes a closure attached to the roof, and the second surface is secured by a fastener to the closure.

10. The system of claim 1 wherein the first building component is a roof bottom at or near a roof eave.

11. The system of claim 10 wherein the second building component is a roof eave support.

12. The system of claim 1 wherein the first building component is a side-wall trim member attached at one end to the side-wall of a building and having an opposite end that matingly conforms to the exterior of the upper surface and connection member.

13. The system of claim 12 wherein the second building component is a roof top of a hip roof that is adjacent to the side-wall of the building.

14. A method of ventilating a building comprising:

an air outlet from the building;

an air inlet into the building;

interposing an air permeable, water and solids blocking member across the air outlet and the air inlet by extending a piece across each of the air outlet and air inlet, the piece including a plurality of apertures, and covering the piece with the air permeable, water and solids blocking member, and supporting a building portion above the member, and connecting the piece to a building portion;

so that air can circulate in and out of the building but water and solids can not enter the building.

15. The method of claim 14 wherein the building has a roof and the air outlet is positioned in the roof.

16. The method of claim 14 wherein the air outlet is positioned at a roof ridge of the building.

17. The method of claim 14 wherein the air inlet is positioned at an eave of the building.

18. The method of claim 14 wherein the air outlet is positioned at a connection between a lean-to building and a main building.

19. The method of claim 14 wherein the air permeable member is a non-woven material.

20. The method of claim 19 wherein the non-woven material is a single layer non-fabric covered, non-wicking, giver-based matting of three-dimensional construction.

21. A bracket for use in venting buildings comprising:

an elongated base wall with first and second opposite edges wherein the base wall is planar and has a width;

a connection wall connected to the base wall along said first edge and extending upwardly to an upper edge;

an upper wall connected to the upper edge of the connection wall and extending over a portion of the base wall, wherein the upper wall has a width and wherein the width of the base wall exceeds the width of the upper wall;

a plurality of openings in the base wall; and an extension connected to the base wall along said second edge and angled upwardly relative to the base wall;

the base wall, connection wall and upper wall defining a space which is configured to receive an air-permeable member.

* * * * *